US012601125B2

(12) United States Patent
Nagasawa et al.

(10) Patent No.: US 12,601,125 B2
(45) Date of Patent: Apr. 14, 2026

(54) BLOCK COMPACTOR

(71) Applicant: MIKASA SANGYO CO., LTD., Tokyo (JP)

(72) Inventors: Kenichi Nagasawa, Saitama (JP); Masaya Sekiguchi, Saitama (JP); Yuichi Nakagomi, Saitama (JP); Yuta Sakai, Saitama (JP)

(73) Assignee: MIKASA SANGYO CO., LTD., Tokyo (JP)

( * ) Notice: Subject to any disclaimer, the term of this patent is extended or adjusted under 35 U.S.C. 154(b) by 663 days.

(21) Appl. No.: 18/165,218

(22) Filed: Feb. 6, 2023

(65) Prior Publication Data

US 2024/0052584 A1 Feb. 15, 2024

(30) Foreign Application Priority Data

Aug. 10, 2022 (JP) ..... 2022-128510

(51) Int. Cl.
*E01C 19/52* (2006.01)
*E01C 19/28* (2006.01)

(52) U.S. Cl.
CPC ..... *E01C 19/52* (2013.01); *E01C 19/281* (2013.01)

(58) Field of Classification Search
CPC ..... E01C 19/52; E01C 19/281; E01C 19/522; E01C 19/526; E01C 19/285; E04F 21/24; B60T 7/08
See application file for complete search history.

(56) References Cited

U.S. PATENT DOCUMENTS 474,038 A * 5/1892 Baugh ..... E01C 19/238 404/129
1,650,574 A * 11/1927 Stubbs ..... E01C 19/281 404/117
3,554,100 A * 1/1971 Mauldin ..... E01C 19/238 404/117

(Continued)

FOREIGN PATENT DOCUMENTS

DE 102013008152 A1 11/2014
JP 3156882 U 1/2010

(Continued)

OTHER PUBLICATIONS

National Institute of Industrial Property (France), Preliminary Search Report for France Patent Application No. 2301235, dated Dec. 22, 2025, 7 pages.

*Primary Examiner* — Abigail A Risic
(74) *Attorney, Agent, or Firm* — Taro Yaguchi

(57) ABSTRACT

A block compactor equipped with a brake mechanism capable of securely locking rollers with a simple structure and stably maintaining a locked state and an unlocked state even when exposed to vibration. A brake pad is fixed to a lower end portion of a brake shaft and is configured to be rotatable together with the brake shaft between two rollers adjacent in the front and rear. By rotating a brake lever, the brake pad can be switched between an unlocked state in which the brake pad does not contact with the outer circumferential surfaces of the rollers, and the rollers are free to rotate, and a locked state in which the brake pad contacts with the outer circumferential surfaces of the rollers, and the rollers cannot rotate with the friction force.

6 Claims, 4 Drawing Sheets

(56) References Cited

U.S. PATENT DOCUMENTS

| | | | | | |
|---|---|---|---|---|---|
| 3,698,293 | A * | 10/1972 | Wagner | E01C 19/282 | 404/117 |
| 4,043,738 | A * | 8/1977 | Modesto | E04F 21/24 | 404/133.05 |
| 4,166,519 | A * | 9/1979 | Maloney | A63C 17/01 | 188/29 |
| 4,320,985 | A | 3/1982 | Kleinemas | | |
| 4,477,203 | A | 10/1984 | Laditka | | |
| 8,414,220 | B1 * | 4/2013 | Koba | E01C 19/285 | 404/117 |
| 10,829,096 | B2 * | 11/2020 | Keller | B60T 11/08 | |
| 2007/0134065 | A1 | 6/2007 | McCoskey | | |
| 2023/0415277 | A1 * | 12/2023 | Christopher | B23K 37/0205 | |

FOREIGN PATENT DOCUMENTS

| | | | |
|---|---|---|---|
| JP | 2010064616 | A | 3/2010 |
| JP | 2010144386 | A | 7/2010 |

* cited by examiner

BLOCK COMPACTOR

CROSS-REFERENCE TO RELATED APPLICATION

This application claims the benefit of Japanese Patent Application No. 2022-128510 filed Aug. 10, 2022. The disclosures of each of the above-mentioned applications are incorporated herein by reference in their entirety.

FIELD OF THE INVENTION

The present invention relates to a block compactor used to align surface height of arranged interlocking blocks when laying those blocks on sidewalks, roadways, parking lots, gardens, or the like.

BACKGROUND OF THE INVENTION

When laying interlocking blocks, the following method is carried out. First, curb stones are arranged at outer edge of a target site, sand is spread on a base layer in an area inside the outer edge to form a bedding sand layer, and the surface is leveled. Numerous blocks are laid side by side, sand is filled in the gaps (joints) between the blocks. Finally, compaction work is performed using a special compactor (a block compactor; a compactor for blocks) is used so that the surface height of the arranged blocks is aligned.

A conventional block compactor consists of a motor (an engine or an electric motor) mounted on a base, an exciter that generates vibration by rotational drive force supplied from the motor, a plurality of rollers rotatably arranged on the underside of the base, and an operating handle extending toward the rear side of the machine body. By pushing and moving the compactor over the arranged blocks, the bedding sand layer under the blocks can be compacted while applying vibration, and the surface height of the blocks can be aligned. At least the surface layers of the rollers are made of an elastic material (hard rubber or the like), which can avoid the generation of loud noise during operation.

PRIOR ART LITERATURE

Patent Literature

Patent Document 1: Japanese Utility Patent No. 3156882

SUMMARY OF THE INVENTION

Technical Problem

In typical conventional block compactors, the rollers are arranged to rotate freely, which may cause the compactor to run by itself due to gravity, if the operator releases the operating handle on a slope, etc. Therefore, installing a parking brake mechanism that can lock the rotation of the rollers is preferred, however, there is a concern that the lock will release itself due to vibration generated by the exciter or vibration during transportation. In addition, the structure should be simple to ensure sufficient durability, assuming that the mechanism will be subject to the impact of vibration.

The present invention attempts to solve such problems of the prior art with a purpose of providing a block compactor equipped with a brake mechanism capable of securely locking rollers with a simple structure and stably maintaining a locked state and an unlocked state even when exposed to vibration.

Solution to Problem

A block compactor of the present invention comprises a base, a motor mounted on the base, an exciter that generates vibration by rotational drive force supplied from the motor, a plurality of rollers, at least the surface layers of which are made of an elastic material, and which are rotatably arranged on the underside of the base, and a parking brake mechanism that can lock the rotation of the rollers, wherein the parking brake mechanism consists of a brake shaft, a brake pad, and a brake lever, wherein the brake pad is fixed to the lower end portion of the brake shaft, and is configured to be rotatable together with the brake shaft at a position between two rollers adjacent in the front and rear among the plurality of rollers, and by rotating the brake lever, the brake shaft and the brake pad are rotated to switch between an unlocked state in which the brake pad does not contact with the outer circumferential surfaces of the two rollers, and these rollers are free to rotate, and a locked state in which the brake pad contacts with the outer circumferential surfaces of the two rollers, and these rollers are unable to rotate due to the frictional force.

The parking brake mechanism is preferably configured such that a rotating side engagement means, which is formed on the brake lever, and a fixed side engagement means, which is fixed at a position near the brake lever, are engaged with each other to inhibit the rotation of the brake lever, when the parking brake mechanism is in the unlocked state and in the locked state.

Preferably, two notches are formed on the brake lever as the rotating side engagement means, a positioning bolt is fixed on the base as the fixed side engagement means, and one of the two notches is formed at a position where it engages with the positioning bolt when the parking brake mechanism is in the unlocked state, and another notch is formed at a position where it engages with the positioning bolt when the parking brake mechanism is in the locked state.

Preferably, the brake shaft or the fixed side engagement means is elastically held by a bushing formed of an elastic material so that it can be tilted from a basic posture, and the brake lever is subject to resistance by the elastic force of the bushing when the engagement of the rotating side engagement means and the fixed side engagement means is released.

Preferably, bolt holes are respectively formed in the brake pad and the lower end portion of the brake shaft, the brake pad is attached to the brake shaft by inserting bolt into the respective bolt holes and tightening the bolt, the vertical length of the bolt holes formed in the brake pad or the lower end portion of the brake shaft is set to be longer than the diameter of the bolt to be inserted so that the mounting height position of the brake pad can be adjusted. In this case, the brake pad is preferably formed in an inverted trapezoidal shape.

Advantageous Effects of Invention

The block compactor in the present invention is equipped with a parking brake mechanism that can securely lock the rollers with a simple structure, which can stably maintain the locked and unlocked states even when exposed to vibration generated by the exciter and vibration during transportation.

DETAILED DESCRIPTION OF THE INVENTION

Figure 1:
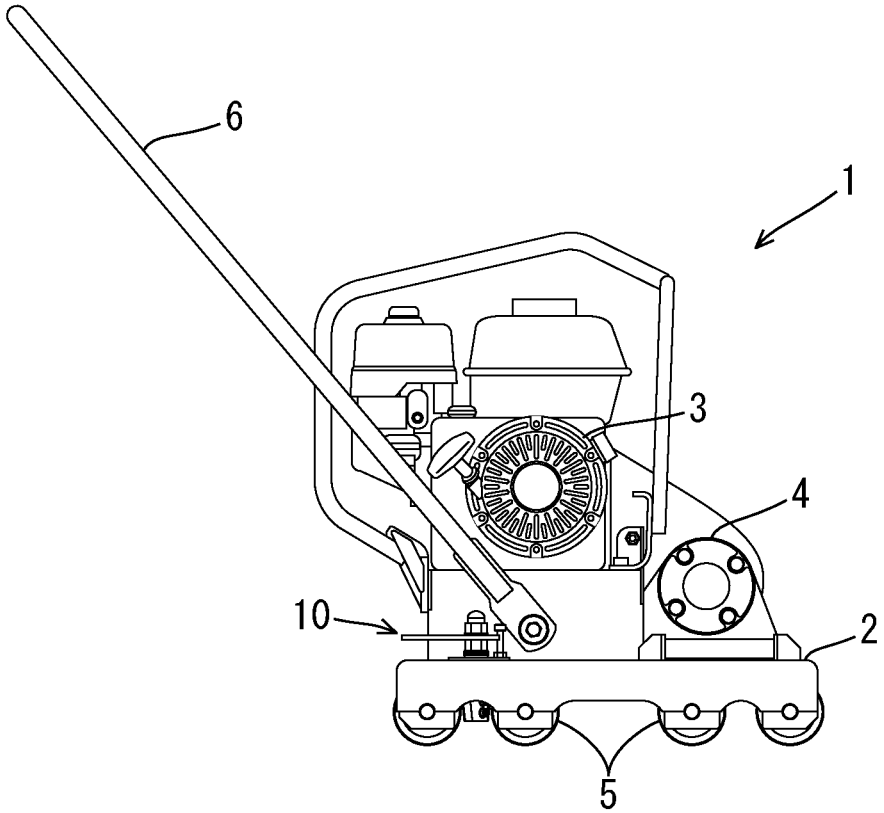
FIG. 1 is a side view of a block compactor 1 of the present invention.

Embodiments of the "Block compactor" of the present invention will be described below with reference to the accompanying drawings. FIG. 1 shows a side view of the block compactor 1 of the present invention. The block compactor 1 consists of a base 2, a motor 3 (an engine or an electric motor) mounted on the base 2, an exciter 4 that generates vibration by rotational drive force supplied from the motor 3, a plurality of rollers 5 (four in this embodiment) rotatably arranged on the underside of the base 2, an operation handle 6 extending towards the rear side of the machine body, and etc.

At least the surface layers of the rollers 5 are made of an elastic material (hard rubber or the like). Since the rollers 5 and the motor 3 are not dynamically connected, the rotational drive force output from the motor 3 is not transmitted to the rollers 5. Therefore, during compaction work, the compactor 1 is used by being manually pushed by an operator holding the operating handle 6.

Figure 2:
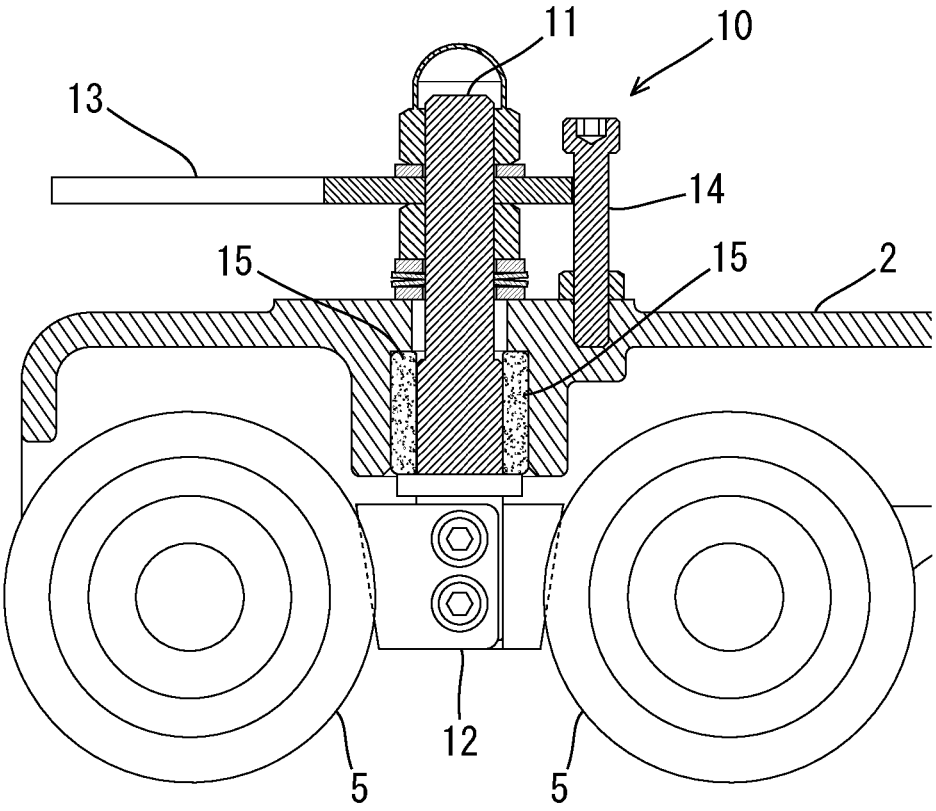
FIG. 2 is a partial cross-sectional view showing a structure of a parking brake mechanism 10 (a locked state) shown in FIG. 1.

The block compactor 1 of the present invention is characterized by having a parking brake mechanism 10 capable of locking the rotation of the rollers 5 (bring it to a state where rotation is impossible). FIG. 2 is a partial cross-sectional view showing a structure of the parking brake mechanism 10. The parking brake mechanism 10 consists of a brake shaft 11, a brake pad 12, a brake lever 13, and etc.

The brake shaft 11 extends vertically by passing through the horizontal portion of the base 2 in the vertical direction and is held in the base 2 so that it can be rotated around the vertical axis. The brake shaft 11 is mounted on the base 2 through a cylindrical bushing 15 formed of an elastic material (rubber in this embodiment). More specifically, as shown in FIG. 2, the bushing 15 is placed around the lower half portion of the brake shaft 11, and the outer side of the bushing 15 is held by the base 2 without direct contact between the brake shaft 11 and the base 2.

Therefore, the brake shaft 11 is elastically held by the bushing 15 and basically maintained in a state where its center axis line is vertical (a basic posture), and configured to tilt slightly (about 3°) when an external force is applied.

The brake pad 12 is formed in a wedge shape (an inverted trapezoid shape), and fixed to the lower end portion of the brake shaft 11, and is configured to rotate with the brake shaft 11 at a position between two rollers 5 adjacent in the front and rear. The brake lever 13 has a base end portion that is fixed to an upper half portion of the brake shaft 11 (a part extending above the base 2) and is configured, by rotating horizontally (around a vertical axis), to rotate the brake shaft 11 and the brake pad 12.

Figure 3:
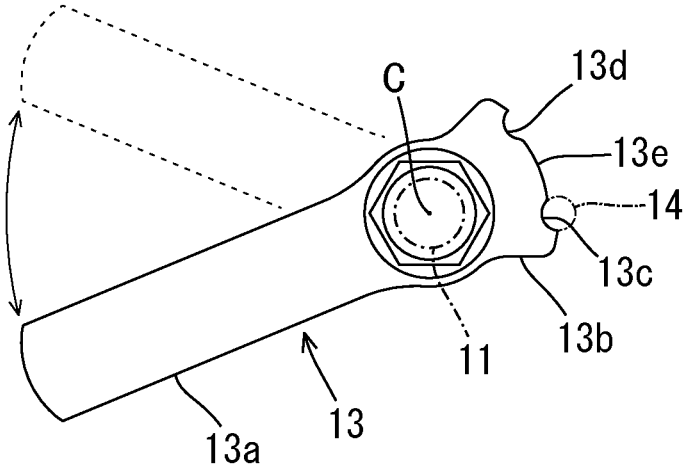
FIG. 3 is a plan view of a brake lever 13 constituting the parking brake mechanism 10 shown in FIG. 1.

FIG. 3 shows a plan view of the brake lever 13. In this embodiment, the brake lever 13 is configured to rotate within a range of 45° from the position shown by the solid line to the position shown by the broken line in FIG. 3, and the compactor 1 can be switched between "unlocked state" and "locked state" by rotating the brake lever 13.

Figure 4:
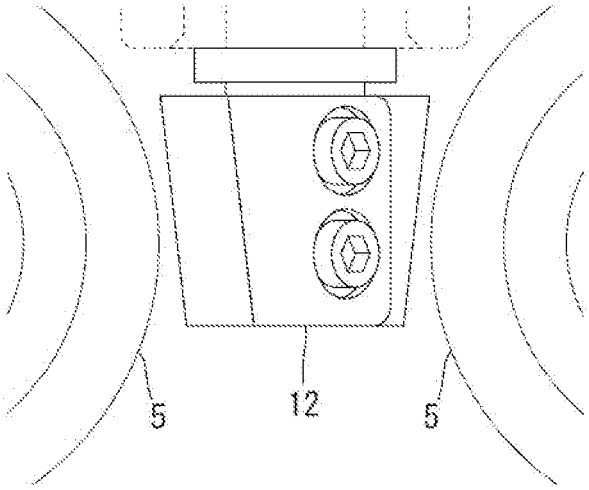
FIG. 4 is a side view of a brake pad 12 (an unlocked state), constituting the parking brake mechanism 10 shown in FIG. 1.

More specifically, when the brake lever 13 is at the position shown by the solid line in FIG. 3 (an unlocked position), the brake pad 12 is not in contact with any of the outer circumferential surfaces of the two rollers 5 adjacent in the front and rear, as shown in FIG. 4, and these rollers 5 are in a rotatable state (an unlocked state). When the brake lever 13 is rotated from this state to the position shown by the broken line in FIG. 3 (a locked position), the brake pad 12 firmly contact with the outer circumferential surfaces of the two rollers 5 adjacent in the front and rear, as shown in FIG. 2, which generates a large amount of frictional force, and the rollers 5 are unable to rotate (a locked state).

The parking brake mechanism 10 employed in this embodiment is configured such that, when the parking brake mechanism is in the unlocked state and in the locked state, the brake lever 13 engages with a positioning bolt 14 (a fixed side engagement means) (see FIG. 2 and FIG. 3) fixed at a position near the brake lever 13, and the rotation of the brake lever 13 is inhibited to stably maintain the unlocked and locked states, respectively.

More specifically, as shown in FIG. 3, the brake lever 13 consists of a grip 13*a* for the operator to grasp, and an extension 13*b* which extends on the opposite side of the grip 13*a* interposing the brake shaft 11. Two notches 13*c* and 13*d* (a rotating side engagement means) are formed at the tip of the extension 13*b*, and an arc-shaped portion 13*e* is formed between the notches 13*c* and 13*d*.

The notches 13*c* and 13*d* are formed at an equal distance from the center axis line C of the brake shaft 11, at an angular interval of 45° measured from the center axis line C. The notch 13*c* is formed at a position where it engages with the positioning bolt 14 when the brake lever 13 is in the unlocked position (the position shown by the solid line in FIG. 3), and the notch 13*d* is formed at a position where it engages with the positioning bolt 14 when the brake lever 13 is in the locked position (the position shown by the broken line in FIG. 3). The arc-shaped portion 13*e* is formed in an arcuate shape having a dimension from the center axis line C that is slightly larger (1.5 mm in this embodiment) than that of the notches 13*c* and 13*d*.

The positioning bolt 14 is fixed on the base 2 and is formed at a position where the brake shaft 11 is maintained vertically when the positioning bolt 14 engages with the notch 13*c* and when it engages with the notch 13*d*. In other words, in this embodiment, the distance from the center axis line C of the brake shaft 11 in the vertical state (the basic posture) to the positioning bolt 14 is set to be equal to the distance from the center axis line C to the notches 13*c* and 13*d*.

Figure 5:
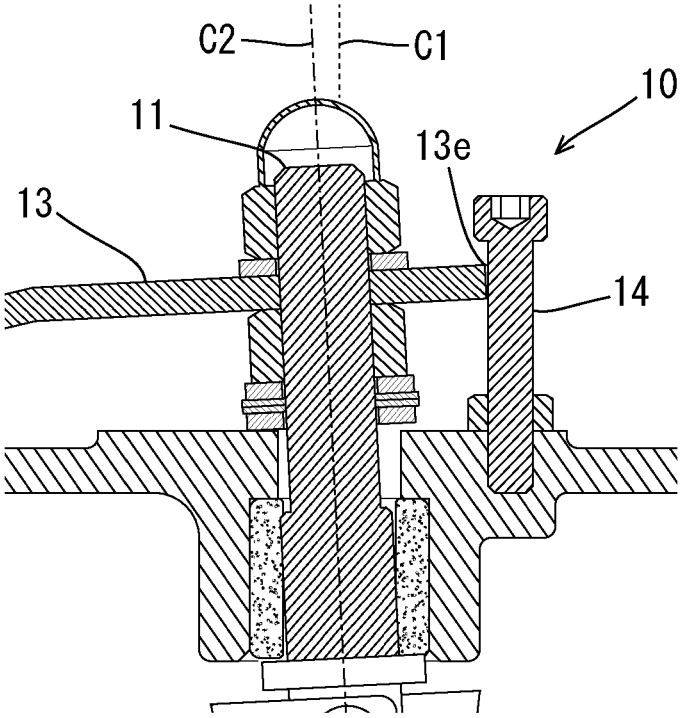
FIG. 5 is a partial cross-sectional view showing a mode of operation of the parking brake mechanism 10 shown in FIG. 1.

As shown by the solid line in FIG. 3, when the positioning bolt 14 is engaged with the notch 13*c* of the brake lever 13, if a force is applied to brake lever 13 in its rotatable direction (towards the locked position shown by the broken line), the engagement of the positioning bolt 14 with the notch 13*c* is released and the positioning bolt 14 abuts against the arc-shaped portion 13*e* formed between the notches 13*c* and 13*d*. At this time, since the dimension from the center axis line C of the brake shaft 11 to the arc-shaped portion 13*e* is slightly larger than that from the center axis line C to the notches 13*c* and 13*d*, as shown in FIG. 5, the brake shaft 11 tilts slightly (from the vertical position C1 of the center axis line of the brake shaft 11 shown by the dotted line in FIG. 5 to the position C2 shown by the dot-dash line) in the direction opposite to the positioning bolt 14.

Therefore, any attempt to rotate the brake lever 13 with the positioning bolt 14 engaged in the notch 13*c* will be resisted by the elastic force of the bushing 15 holding the brake shaft 11. When the brake lever 13 is rotated and reaches the locked position shown by the broken line in FIG. 3, the positioning bolt 14 engages with the notch 13*d* and the brake shaft 11 returns to the vertical state (the basic posture). Also, when attempting to rotate the brake lever 13 towards the opposite direction (from the locked position shown by the broken line to the unlocked position shown by the solid line in FIG. 3), the rotation will be resisted by the elastic force of the bushing 15.

Thus, in this embodiment, the notch 13*c* or 13*d* of the brake lever 13 engages with the positioning bolt 14 to prevent the brake lever 13 from rotating even when exposed to vibration generated by the exciter 4 or during transportation. This enables avoiding situations such as the brake pads 12 in the unlocked state rotating and coming into contact with the rollers 5 or the brake pads 12 in the locked state rotating and getting unlocked, and stability of the unlocked and locked states can be maintained respectively.

In the above embodiment, the brake shaft 11 is configured to tilt when the positioning bolt 14 contacts the arc-shaped portion 13*e*, however, the positioning bolt 14 (the fixed side engagement means) may be configured to tilt elastically instead of the brake shaft 11.

In the above embodiment, two notches 13*c* and 13*d* (the rotating side engagement means) are formed in the brake lever 13, and the positioning bolt 14 (the fixed side engagement means) engages with one of the notches to prevent the brake lever 13 from rotating. Instead, it may be configured such that a member (not shown) formed with a plurality of notches is fixed to the positioning bolt 14 or the like as the fixed side engagement means, and a convex portion (the rotation side engagement means) (not shown) that can engage with one of the notches is formed in the brake lever 13, and the rotation of the brake lever 13 is inhibited by the engagement between the fixed side engaging means (the notches) and the rotation side engagement means (the convex portion).

In addition, a single notch (the rotation side engagement means or the fixed side engagement means) may be configured to engage a plurality of convex portions (the fixed side engagement means or the rotation side engagement means).

The parking brake mechanism 10 employed in this embodiment is configured to enable adjustment of the height position of the brake pads 12 that are attached to the brake shaft 11. Specifically, as shown in FIG. 6, the brake pads 12 are arranged one by one on both sides so as to sandwich the lower end portion 11*a* (formed in a plate shape) of the brake shaft 11, and are attached to the brake shaft 11 by inserting bolts 16 through the respective bolt holes 12*a*, 11*b*, 12*b* and tightening them.

Figure 6:
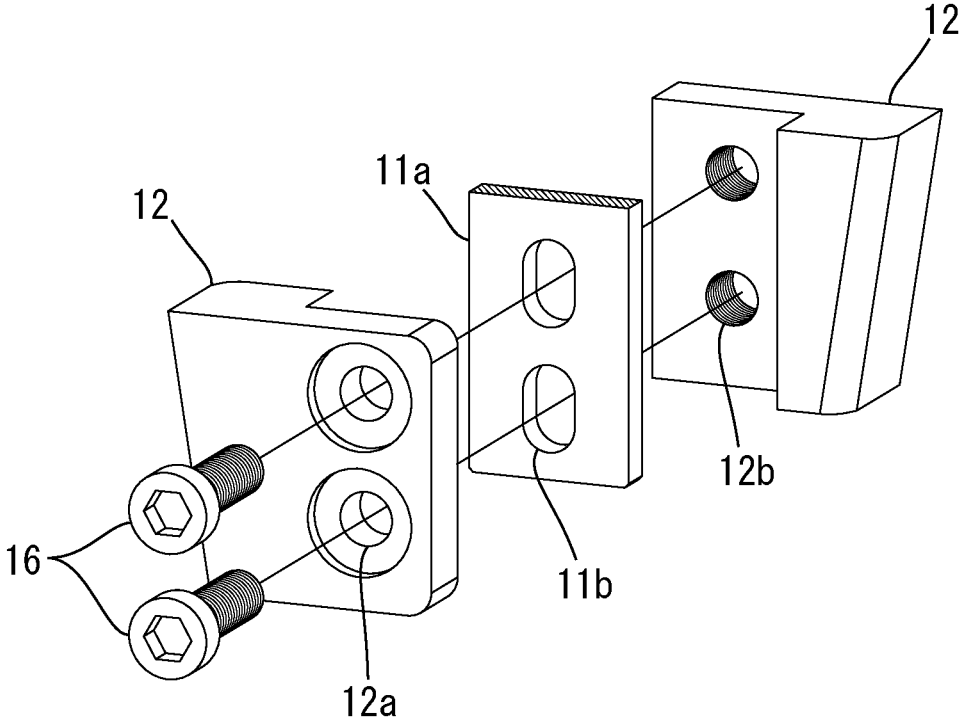
FIG. 6 is an exploded perspective view of the brake pad 12 constituting the parking brake mechanism 10 shown in FIG. 1.

As shown in FIG. 6, since the bolt hole 11*b* formed in the lower end portion 11*a* of the brake shaft 11 has a vertical length that is longer (about twice as long) than the diameter of the bolt 16 to be inserted, the mounting height position of the brake pads 12 can be adjusted by changing the insertion position of the bolt 16 vertically. Since the brake pads 12 are formed in a wedge shape (an inverted trapezoidal shape), changing the height position changes the contact pressure against the rollers 5 (see FIG. 2), enabling the braking force to be adjusted.

Even when the vertical length of the bolt holes 12*a* and 12*b* formed in the brake pads 12 are set to be longer than the diameter of the bolt 16 to be inserted, the mounting height position of the brake pad 12 can be adjusted, enabling the adjustment of the braking force.

REFERENCE NUMERALS

1 Block compactor
2 Base
3 Motor
4 Exciter
5 Roller
6 Operation handle
10 Parking brake mechanism
11 Brake shaft
11*a* Lower end portion
11*b* Bolt hole
12 Brake pad
12*a*, 12*b* Bolt hole
13 Brake lever
13*a* Grip
13*b* Extension
13*c*, 13*d* Notch
13*e* Arc-shaped portion
14 Positioning bolt
15 Bushing
16 Bolt

The invention claimed is:

1. A block compactor, comprising:

a base; a motor mounted on the base; an exciter that generates vibration by rotational drive force supplied from the motor; a plurality of rollers, at least the surface layers of which are made of an elastic material, and which are rotatably arranged on the underside of the base; and a parking brake mechanism that can lock the rotation of the rollers, wherein:

the parking brake mechanism consists of a brake shaft, a brake pad, and a brake lever;

the brake pad is fixed to the lower end portion of the brake shaft, and is configured to be rotatable together with the brake shaft at a position between two rollers adjacent in the front and rear among the plurality of rollers; and by rotating the brake lever, the brake shaft and the brake pad are rotated to switch between an unlocked state in which the brake pad does not contact with the outer circumferential surfaces of the two rollers, and these rollers are free to rotate, and a locked state in which the brake pad contacts with the outer circumferential surfaces of the two rollers, and these rollers are unable to rotate due to the frictional force.

2. The block compactor according to claim 1, wherein:

the parking brake mechanism is configured such that a rotating side engagement means, which is formed on the brake lever, and a fixed side engagement means, which is fixed at a position near the brake lever, are engaged with each other to inhibit the rotation of the brake lever, when the parking brake mechanism is in the unlocked state and in the locked state.

3. The block compactor according to claim 2, wherein:

two notches are formed on the brake lever as the rotating side engagement means;

a positioning bolt is fixed on the base as the fixed side engagement means; and one of the two notches is formed at a position where it engages with the positioning bolt when the parking brake mechanism is in the unlocked state, and another notch is formed at a position where it engages with the positioning bolt when the parking brake mechanism is in the locked state.

4. The block compactor according to claim 2, wherein:

the brake shaft or the fixed side engagement means is elastically held by a bushing formed of an elastic material so that it can be tilted from a basic posture, and the brake lever is subject to resistance by the elastic force of the bushing when the engagement of the rotating side engagement means and the fixed side engagement means is released.

5. The block compactor according to claim 1, wherein:

bolt holes are respectively formed in the brake pad and the lower end portion of the brake shaft;

the brake pad is attached to the brake shaft by inserting bolt into the respective bolt holes and tightening the bolt;

the vertical length of the bolt holes formed in the brake pad or the lower end portion of the brake shaft is set to be longer than the diameter of the bolt to be inserted so that the mounting height position of the brake pad can be adjusted.

6. The block compactor according to claim 5, wherein:

the brake pad is formed in an inverted trapezoidal shape.

* * * * *